United States Patent [19]

Windt et al.

[11] 4,421,556

[45] Dec. 20, 1983

[54] METHOD FOR DECONTAMINATION OF NICKEL-FLUORIDE-COATED NICKEL CONTAINING ACTINIDE-METAL FLUORIDES

[75] Inventors: Norman F. Windt; Joe L. Williams, both of Paducah, Ky.

[73] Assignee: The United States of America as represented by the U.S. Department of Energy, Washington, D.C.

[21] Appl. No.: 453,983

[22] Filed: Dec. 28, 1982

[51] Int. Cl.[3] ..... C22B 23/06; C22B 60/02

[52] U.S. Cl. ..... 75/63; 75/10 R; 75/82; 75/122.7

[58] Field of Search ..... 75/10 R, 0.5 BA, 82, 75/63, 84.1 A, 122.7

[56] References Cited

U.S. PATENT DOCUMENTS 3,867,136 2/1975 Eriksson et al. ..... 75/82

*Primary Examiner*—M. J. Andrews

*Attorney, Agent, or Firm*—Fred O. Lewis; Stephen D. Hamel; Richard G. Besha

[57] ABSTRACT

The invention is a process for decontaminating particulate nickel contaminated with actinide-metal fluorides. In one aspect, the invention comprises contacting nickel-fluoride-coated nickel with gaseous ammonia at a temperature effecting nickel-catalyzed dissociation thereof and effecting hydrogen-reduction of the nickel fluoride. The resulting nickel is heated to form a melt and a slag and to effect transfer of actinide metals from the melt into the slag. The melt and slag are then separated. In another aspect, nickel containing nickel oxide and actinide metals is contacted with ammonia at a temperature effecting nickel-catalyzed dissociation to effect conversion of the nickel oxide to the metal. The resulting nickel is then melted and separated as described. In another aspect nickel-fluoride-coated nickel containing actinide-metal fluorides is contacted with both steam and ammonia. The resulting nickel then is melted and separated as described. The invention is characterized by higher nickel recovery, efficient use of ammonia, a substantial decrease in slag formation and fuming, and a valuable increase in the service life of the furnace liners used for melting.

9 Claims, 3 Drawing Figures

METHOD FOR DECONTAMINATION OF NICKEL-FLUORIDE-COATED NICKEL CONTAINING ACTINIDE-METAL FLUORIDES

BACKGROUND OF THE INVENTION

This invention relates generally to processes for the decontamination of metallic nickel and, more specifically, to the decontamination of particulate nickel having a thin surface coating of metallic fluoride and containing actinide-metal fluorides. The invention is a result of a contract with the United States Department of Energy.

The invention was developed in response to problems encountered in attempts to decontaminate crushed metallic nickel scrap to produce purified saleable nickel ingots. The scrap was covered with a surface film of nickel fluoride and contained various radionuclides in the form of chemically active fluorides. The typical batch of the scrap contained the following: nickel fluoride (~1.2%); nickel oxide (~0.5%); uranium (~200 ppm); neptunium (~45 ppb); plutonium (~0.1 ppb); thorium (~0.15 ppb); and technetium (~60 ppm). The scrap was melted in a conventional electrical induction furnace having a rammed liner composed essentially of compacted and sintered ceramic. In a typical run, good decontamination was achieved in the melting operation; that is, with the exception of technetium, the radioactive contaminants were removed effeciently by transfer into slag and the furnace liner. However, serious operational problems occurred during melting. Some of the nickel fluoride reacted and/or decomposed, producing objectionable gaseous-fluoride emissions. Also, residual fluoride reacted with the furnace liner, reducing its life and creating a potential for serious safety hazards.

In an attempt to overcome these problems, a pre-treatment for the nickel scrap was developed to remove fluoride ions therefrom. The pre-treatment comprised contacting the scrap with steam to effect the following reaction (among others).

$$NiF_2+H_2O \rightarrow NiO+2HF$$

This was accomplished in a rotary calciner, where the scrap was contacted with 20% steam in nitrogen at 1200° F. for 30 minutes, at a flow rate of 8 stoichiometric quantities of steam. The pre-treatment destroyed the nickel-fluoride film effectively, as well as the other fluorides. The succeeding melting operation decreased the actinide-metal concentrations in the melt by satisfactorily large percentages. Unfortunately, the pre-treatment also increased the NiO content of the scrap to ~4%. This resulted in the formation of excessive nickel oxide slag, which caused pouring problems, significant decreases in the service life of the liner, and a decrease in the value of the potentially saleable product nickel. Refinements of the steam-treatment system decreased the NiO concentration to nearly 2.1% (the theoretical minimum), but this did not decrease the NiO-associated problems to an acceptable degree. Pre-treatment of the scrap with methane resulted in a nickel metal having more uranium, neptunium, and plutonium contamination than the steam-treated scrap.

SUMMARY OF THE INVENTION

Accordingly, it is an object of this invention to provide a novel decontamination process for particulate nickel scrap having a surface film of nickel fluoride and containing nickel oxide and various actinide-metal fluorides.

It is another object to provide a process of the kind just described, the process including a melting operation for effecting large-percentage decreases in the concentrations of the actinide metals.

It is another object to provide a process for decontaminating nickel-oxide-containing nickel scrap containing actinide metals as contaminants, the process including a nickel-melting operation which effects decontamination without generating excessive slag.

Other objects and advantages will be made evident hereinafter.

In one aspect, the invention is a process for decontaminating nickel scrap of the kind identified above, under "Background". The process comprises contacting the scrap with gaseous ammonia at a temperature promoting nickel-catalyzed dissociation of the ammonia and hydrogen-reduction of the nickel fluoride and nickel oxide. The resulting scrap is heated to form a metal and a slag and to effect transfer of at least some of the actinide-metal contaminants into the slag. The melt and slag then are separated. In another aspect, decontamination of the nickel scrap is effected by contacting the same with gaseous ammonia and steam at a temperature promoting nickel-catalyzed dissociation of the ammonia and effecting (a) conversion of the nickel fluoride to nickel oxide and (b) reduction of the nickel oxide. The nickel so contacted then is heated to form a melt and slag and effect transfer of at least some of the actinide-metal fluorides into the slag. The slag and melt then are separated. In another aspect, particulate nickel containing nickel oxide and actinide-metal contaminants is contacted with gaseous ammonia at a temperature promoting its dissociation and effecting hyrogen-reduction of the nickel oxide. This is followed by the above-mentioned heating and separating operations. In another aspect, a bed of the same scrap is contacted in a first zone with gaseous ammonia at a temperature promoting nickel-catalyzed dissociation of the ammonia. The dissociation products are fed to a second zone containing additional nickel scrap and at a temperature effecting hydrogen-reduction of the nickel fluoride and the nickel oxide. This is followed by the above-mentioned heating and separating operations.

DETAILED DESCRIPTION OF THE INVENTION

Our decontamination process, which includes a pre-treatment operation, will be illustrated as applied to "typical" nickel scrap of the kind described above—i.e., particulate nickel having a surface coating of nickel fluoride and containing nickel oxide and radioactive contaminants in the form of technetium fluoride and actinide-metal fluorides. (See "Background" for concentrations of the contaminants.) Briefly, we have found that when utilized in the pre-treatment of such scrap, ammonia functions as an unexpectedly efficient source of hydrogen for reducing $NiF_2$ and NiO. The reactions are summarized as follows:

$$2NH_3+3NiF_2 \rightarrow 3Ni+6HF+N_2$$

$$2NH_3+3NiO \rightarrow 3Ni+3H_2O+N_2$$

We have also found that when ammonia is substituted for steam in the pre-treatment, there is a marked decrease in the amount of slag generated during furnacing. This in turn leads to substantial savings because of increased liner life and increased nickel recovery. Furthermore, the pouring problems associated with excessive slag are decreased, providing a safer furnacing operation. As will be decribed, gains also are obtained if ammonia and steam are used in combination in the pre-treatment operation.

Figure 1:
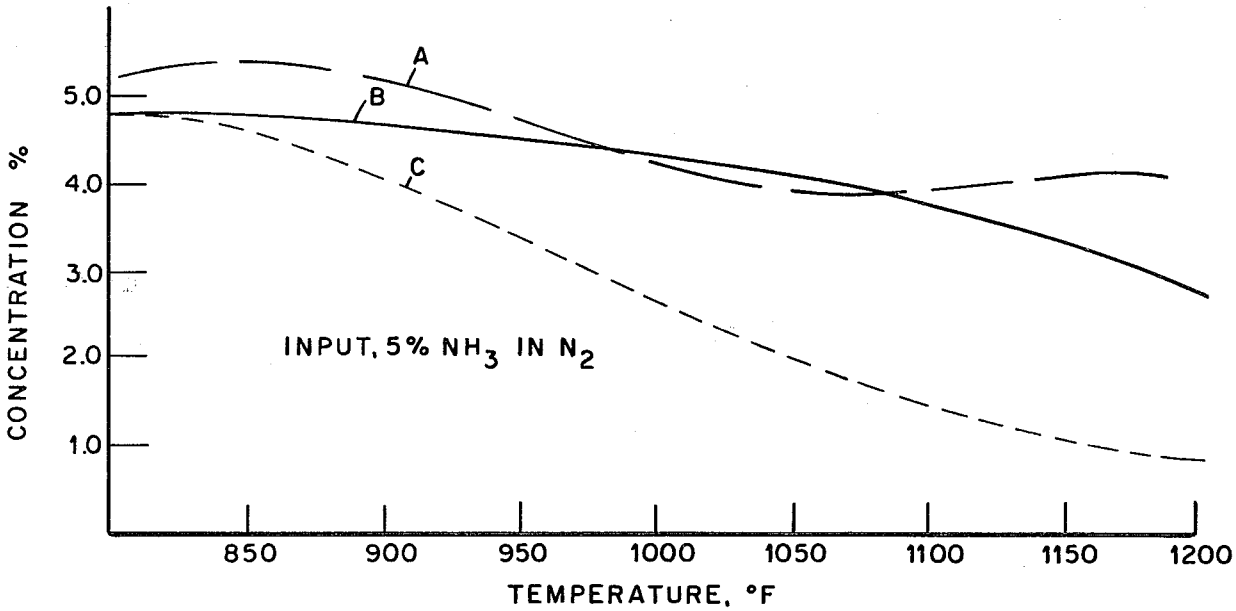
FIG. 1 is a graph comparing the extent to which ammonia is dissociated when passed through a heated reactor when empty, when charged with steel wool, and when charged with particulate nickel scrap.

An advantage of our process is that the nickel scrap itself promotes efficient utilization of the ammonia. That is, the particulate scrap surface-catalyzes the dissociation of the ammonia into nascent nitrogen and hydrogen. This beneficial effect has been demonstrated in tests where we passed 5% $NH_3$ through a heated reactor and monitored the composition of the outlet stream to determine the degree of ammonia dissociation. Referring to FIG. 1, curves A, B, and C compare the ammonia concentrations in the outlet stream at various temperatures for the reactor when empty (Curve A), charged with steel wool (Curve B), and charged with the nickel scrap (Curve C). As shown, the scrap provided a gain in ammonia dissociation (i.e., utilization) at each temperature investigated; the amount of the gain increased with temperature. Thus, ammonia costs are relatively low in our process.

EXAMPLE I

Decontamination Process Including Steam-and-Ammonia Pre-treatment

Figure 2:
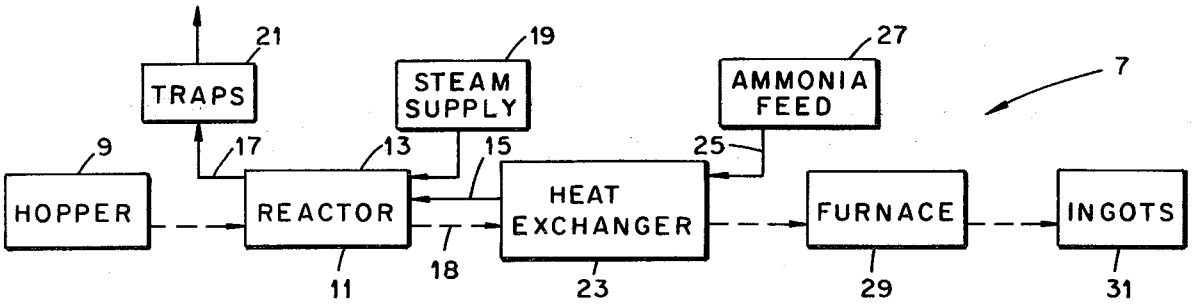
FIG. 2 is a block diagram of a system for conducting the invention.

Referring to FIG. 2, a large-scale batchwise test of the invention was conducted in a system 7 composed throughout of conventional components. The system included a hopper 9 for discharging nickel scrap into a reactor (rotary calciner) 11. The reactor was provided with inlets 13 and 15 for steam and 100% ammonia, respectively, and with gas and solids outlets 17 and 18, respectively. The steam was derived from a supply 19. Calcium carbonate traps 21 were provided to remove HF from the gas outflow from the reactor. A heat exchanger 23 was provided to cool scrap received from the reactor (thus avoiding atmospheric oxidation of the scrap) and to pre-heat the ammonia input to the reactor. The heat exchanger was provided with an inlet 25 for receiving a metered flow of ammonia from a feed station 27. An air-atmosphere induction furnace 29 having a rammed liner of the kind previously described was provided to melt the cooled scrap and to pour molten nickel into ingots 31.

In a typical run, the nickel scrap was fed to the reactor at a rate of 1200 lbs/hr., where it was pre-treated at 1100° F. for 1 hour with a mixture of steam and ammonia, the steam preferentially reducing the $NiF_2$ to the oxide, and the ammonia preferentially reducing the NiO to Ni. The steam was admitted continuously through inlet 13 at a rate of ~4 stoichiometric quantities with respect to the $NiF_2$. The ammonia was admitted continuously through inlet 15 at a rate of 1.5 to 2.0 CFM, which is equivalent to about one stoichiometric quantity with respect to the NiO. After pre-treatment, the scrap was cooled to about 150° F. in the heat exchanger 23 and then transferred to the furnace 29, where it was maintained at ~2800° F. for ~0.75 hour. The resulting decontaminated molten nickel then was poured into the ingots 31.

The process test was highly successful. During melting, the radioactive contaminants (except technetium) were efficiently removed. Although most (>90%) of the technetium remained in the melt, the concentrations of the actinide metals were decreased to below detachable limits, those limits being as follows: <1 ppm uranium; <1 ppb neptunium-237; <0.01 ppb plutonium-239; and <0.003 ppb thorium-230. A total of 100,000 pounds of the treated scrap was melted in a single furnace liner, whereas earlier tests conducted with scrap pre-treated with steam alone averaged only 40,000 pounds before excessive slagging and/or liner deterioration terminated operations. In contrast to the earlier operations, fuming was not a serious problem. Analyses showed that the ammonia-and-steam pre-treatment was as effective as steam alone with respect to decontamination of the melt, while alleviating the problems due to excess slag.

EXAMPLE II

Decontamination Process Including Pre-Treatment With Ammonia Only

In another application of the invention, typical nickel scrap was pre-treated with ammonia only and then decontaminated by melting. In a typical operation, conducted in the system shown in FIG. 1, the scrap was fed to the reactor 11 at the rate of 1200 lbs/hr. Pre-treatment was conducted for ~1 hour at a temperature of 1100° F. Ammonia was admitted continuously to the reactor at a rate of 1.5 to 2.0 CFM, to effect removal of fluorides and NiO from the scrap. Approximately 65% of the ammonia input dissociated in the reactor. After cooling to about 150° F., the treated scrap was transferred to the induction furnace 29, where it was maintained at ~2800° F. for ~0.75 hour. The melt then was poured into the ingots 31.

The process was highly satisfactory. Slagging and fuming were minimal in the melting operation. Decontamination was effected to essentially the same degree as in Example I. More than 200,000 pounds of the scrap was satisfactorily decontaminated in this manner in a single furnace liner.

EXAMPLE III

Ammonia Pre-Treatment of Scrap Previously Treated with Steam Only

The invention was used to decontaminate typical nickel scrap which had previously been pre-treated with steam alone. In a typical instance, the steam-treated scrap contained ~2.0% NiO. The scrap was re-treated with ammonia alone in the system shown in FIG. 1. The ammonia treatment was conducted at 1100° F. for 1 hour. The ammonia was fed to the reactor at a constant rate of 1.5 to 2.0 CFM reducing the NiO content to about 0.5%. After cooling, the scrap was loaded in the furnace 29 and maintained at 2800° F. for ~45 min., following which it was poured into the ingots 31. Decontamination was satisfactory, being on the order of that obtained in Example I. Slagging and fuming were minimal. Over 240,000 pounds of scrap was so processed in a single furnace liner.

EXAMPLE IV

Decontamination Process Including Pre-Treatment with Pre-cracked Ammonia

Figure 3:
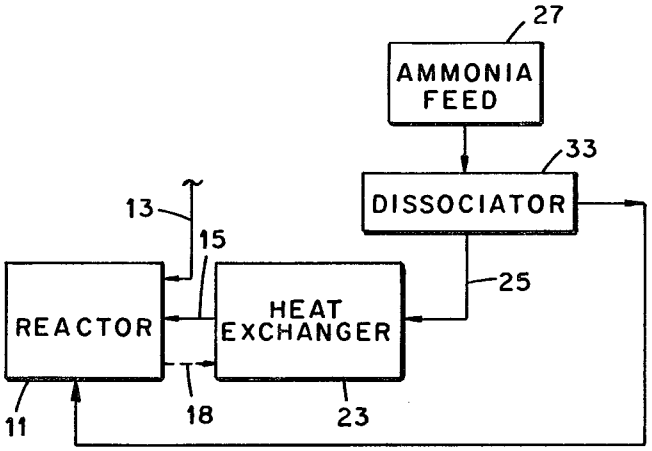
FIG. 3 is a block diagram of a modified portion of the system shown in FIG. 2.

In another form of the invention, the pre-treatment is conducted with pre-cracked ammonia to obtain even higher utilization of the ammonia. As indicated in FIG. 3, ammonia is fed to a heated dissociator 33 containing untreated nickel scrap of the kind previously described. Preferably, the ammonia is fed at a rate ensuring dissociation of at least 95% thereof. To give a specific example, the dissociator may contain ~40 pounds of scrap and be maintained at a temperature of 1600° F. The ammonia flow rate to the dissociator may be 6 CFM. As shown, the cracked ammonia is fed to the reactor 11, where it is utilized to pre-treat fresh scrap, as previously described. The scrap in the dissociator may be so used indefinitely.

Referring to our invention more generally, the pre-treatment operation can be effected with ammonia alone or ammonia-steam mixtures at reactor temperatures preferably ranging from about 1100° to 1200° F. and stoichiometric excesses in the range of from about 3 to 7 for steam and 1 to 4 for ammonia. Appreciable removal of the actinide metals can be effected by furnacing at temperatures in the range of from about 2700° F. to 2900° F. It is our opinion that our decontamination process is not limited to removal of the above-named actinide-metal fluorides but rather is applicable to actinide-metal fluorides in general. Referring to technetium, if a further decrease in the concentration of this contaminant is required, the product metal may be combined with scrap having a lower technetium content and re-processed.

As shown, our invention accomplishes the above-cited objects and provides valuable advantages over the previous art. Decontamination is accomplished effectively with fewer operational problems, decreased hazard, markedly increased furnace life, and increased product purity with respect to NiO.

Given the teachings presented above, various modifications and adaptations of the invention will be apparent to those versed in the art. The foregoing description has been presented for illustrative purposes to enable such persons to best utilize the principles of the invention. They will be able to determine the process parameters most suitable for a given application, without resorting to more than routine experimentation. The scope of the invention is to be determined from the appended claims.

What is claimed is:

1. A process for decreasing the concentration of actinide-metal contaminants present in particulate nickel having a surface coating of nickel fluoride and containing nickel oxide, said process comprising:

contacting said nickel with gaseous ammonia in a reaction zone at a temperature promoting nickel-catalyzed dissociation of said ammonia into hydrogen and nitrogen to effect hydrogen-reduction of said nickel fluoride and nickel oxide, heating the nickel so contacted to form a melt and a slag and to effect transfer of at least some of said actinide-metal contaminants from said melt into said slag, and separating the resulting melt from said slag.

2. The process of claim 1 wherein said nickel is contacted with ammonia in stoichiometric excess with respect to said nickel fluoride.

3. The process of claim 1 wherein said reaction zone is at a temperature in the range of from about 1100° F. to 1200° F.

4. A process for decreasing the concentration of actinide-metal contaminants present in particulate nickel-fluoride-coated nickel, said process comprising:

contacting said nickel with gaseous ammonia and steam in a reaction zone at a temperature promoting nickel-catalyzed decomposition of said ammonia into hydrogen and nitrogen and effecting (a) conversion of said nickel fluoride to nickel oxide and (b) reduction of said nickel oxide, heating the nickel so contacted to form a melt and a slag and to effect transfer of at least some of said actinide-metal fluorides from said melt into said slag, and separating said melt from said slag.

5. The process of claim 4 wherein said nickel is contacted with steam in stoichiometric excess with respect to said nickel fluoride and with ammonia in stoichiometric excess with respect to said nickel oxide.

6. The process of claim 5 wherein said reaction zone is at a temperature in the range from about 1100° F. to 1200° F.

7. A process for decreasing the concentration of actinide-metal contaminants present in particulate nickel containing nickel oxide, said process comprising:

contacting said nickel with gaseous ammonia in a reaction zone at a temperature promoting nickel-catalyzed dissociation of said ammonia into hydrogen and nitrogen to effect hydrogen-reduction of said nickel oxide, heating the nickel so contacted to form a melt and a slag and to effect transfer of at least some of said actinide-metal contaminants from said melt into said slag, and separating said melt from said slag.

8. The process of claim 7 wherein said ammonia is in stoichiometric excess with respect to said nickel oxide.

9. The process of claim 7 wherein said reaction zone is at a temperature in the range of 1100° F. to 1200° F.

* * * * *